US006965731B2

(12) United States Patent
Huang et al.

(10) Patent No.: US 6,965,731 B2
(45) Date of Patent: Nov. 15, 2005

(54) CONVECTIONAL RADIAL ELECTRIC WARMER

(76) Inventors: Chuan-Pan Huang, No. 17, Hsinjen Rd., Tainan City (TW); Chen-Lung Huang, No. 17, Hsinjen Rd., Tainan City (TW)

( * ) Notice: Subject to any disclaimer, the term of this patent is extended or adjusted under 35 U.S.C. 154(b) by 85 days.

(21) Appl. No.: 10/777,280

(22) Filed: Feb. 9, 2004

(65) Prior Publication Data

US 2005/0175329 A1 Aug. 11, 2005

(51) Int. Cl.[7] ..... F23H 3/00

(52) U.S. Cl. ..... 392/373; 392/374; 392/375; 392/376

(58) Field of Search ..... 392/373–376, 392/347, 351–352, 438–439; 219/543, 536–537, 219/520, 522

(56) References Cited

U.S. PATENT DOCUMENTS 2,495,788 A * 1/1950 Trist ..... 392/435
2,613,308 A * 10/1952 La Mirand ..... 219/473
2,717,950 A * 9/1955 Nathanson ..... 392/439
2,795,682 A * 6/1957 Knoll ..... 392/439
3,211,889 A * 10/1965 McEachron ..... 392/439
3,767,895 A * 10/1973 Needham ..... 392/438

FOREIGN PATENT DOCUMENTS

| | | | |
|---|---|---|---|
| CN | 1401941 | 3/2003 | |
| GB | 605903 | * 8/1948 | ..... 392/373 |
| TW | 470155 | 12/1990 | |
| TW | 551482 | 9/1992 | |

* cited by examiner

*Primary Examiner*—Robin O. Evans
*Assistant Examiner*—Vinod Patel

(57) ABSTRACT

A conventional radial electric warmer includes an upper and a lower support base, plural heaters, a protective net, and an upper, a front and a rear cover. The upper and the lower support base respectively have a fixing frame for the heaters, and plural holes for hot air to flow out. The heaters respectively consist of plural heating pieces secured at the outside of the upper and the lower support base with the fixing frames with bolts. The protective net is secured at the front side of the heaters, secured stably by the upper and the lower support base. The upper, the front and the rear cover are respectively secured at the upper side, the front side and the rear side of the upper and the lower support base. Further, two foot frames are fixed under the lower support base to keep the warmer standing on the ground. Then the warmer is very safe to use and highly effective.

3 Claims, 3 Drawing Sheets

CONVECTIONAL RADIAL ELECTRIC WARMER

FIELD OF THE INVENTION

This invention relates to a convectional radial electric warmer, particularly to one provided with a heater with an electric heating film formed on an insulating base printed beforehand with concocted electric resistance plasma by means of a net printing process and then burned by a high temperature burning process. Then this warmer is extremely safe to use and highly effective.

BACKGROUND OF THE INVENTION

A first conventional electric warmer disclosed in a Taiwan patent of No. 551482, includes a housing, an electrical heating tube, two fixing units, two inserting cylinders and two springs. The fixing units consists of a front one and rear one, and the rear fixing unit has a fixing member extending to one side, and the front fixing unit has an inverted ⊏-shaped sealing surface in its front section, and a hole bored in the sealing surface. Then the sealing surface and the rear fixing unit have a round hole in an upper flat surface for one insert cylinder to fit therein. Each insert cylinder has a groove respectively in an upper and a lower portion of its outer wall, and a groove in an inner wall. Each spring has a large diameter in an upper portion and a small diameter in a lower portion, and the large upper portion can fit in the groove of the inner wall and is fixed in the insert cylinder, and the small lower portion supports the electric heating tube to let it not fall down. The electric heating tube is inserted in the spring fixed in the insert cylinder, supported by the small diameter portion. Then the insert cylinder together with the electric heating tube and the spring is inserted in the round hole and the square hole of the fixing units, with the grooves of the outer wall of the insert cylinder fit with the round hole and the square hole of the fixing units. Then the fixing units are fixed in the housing of the warmer.

The first conventional electric warmer just described, having an electric heating tube made of quartz, has a disadvantage that the heating coefficient of the quartz heating tube is high and its temperature is not easy to control.

A second conventional electric warmer using infrared ray disclosed in Taiwan patent of No. 470155 includes a body and a heating element arranged in the body, and a decorative net plate combined with the front side of the body, which is formed with thin plates surrounding a hollow interior, plural fixing bases provided in the interior for combining electric heating plates coated with electrical heating films connected with a switch on a side of the body by conductive terminals and wires. Then the switch can control the heating plates. The electrically heating plates are not only kept stably by the fixing units but also by a special sloped surface of a press plate respectively fixed with bolts in two sides of the body.

A third conventional convectional radial electric warmer disclosed in a China patent of No. CN 1401941A includes an electric heating plate fixed stably by a frame, two sides plates and two lateral rods, an upper housing, a left housing and a right housing and a metal net combined together. The electric heating plate has electric heating films, which is formed with many kinds of inorganic oxides formed on an electrical insulating base by means of chemical evaporation and sediment process. This third conventional electric warmer is costly, requiring complicated processes.

SUMMARY OF THE INVENTION

This invention has been devised to offer a convectional radial electric warmer, which is very safe to use. The invention has the following features.

1. It has an upper and a lower support base provided respectively with a fixing frame for an electric heater, a protective net, a front cap and a rear cap. The upper and the lower support base have plural holes for hot air to flow out. The electric heater consists of plural heating pieces secured stably at the outer sides of the upper and the lower support base and with the fixing frame. The protective net is fixed at an outer side of the heater. The front cap and the rear cap are separately fixed with the front side and the rear side of the upper and the lower support base, and supported by two foot frames.

2. It has a safety switch under the front cover to automatically cut off the power to keep the warmer safe in case of the warmer inclining and falling down.

3. It has heaters provided with an electric heating film, which is made of concocted electric resistance plasma printed on an electrical insulating base by means of a net printing process and then burned by means of a high temperature burning process.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
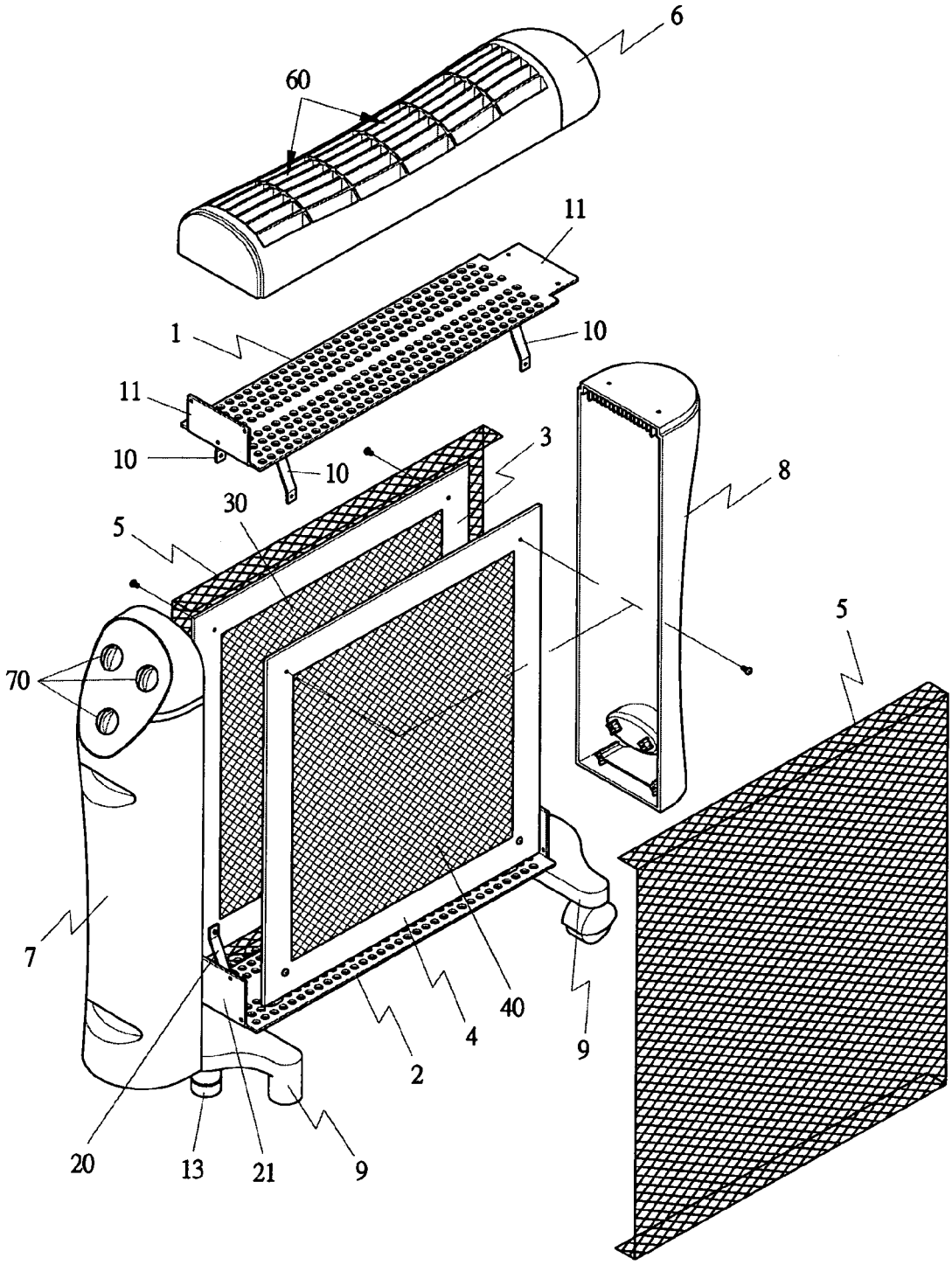
FIG. 1 is an exploded perspective view of a convectional radial electric warmer in the present invention.
Figure 2:
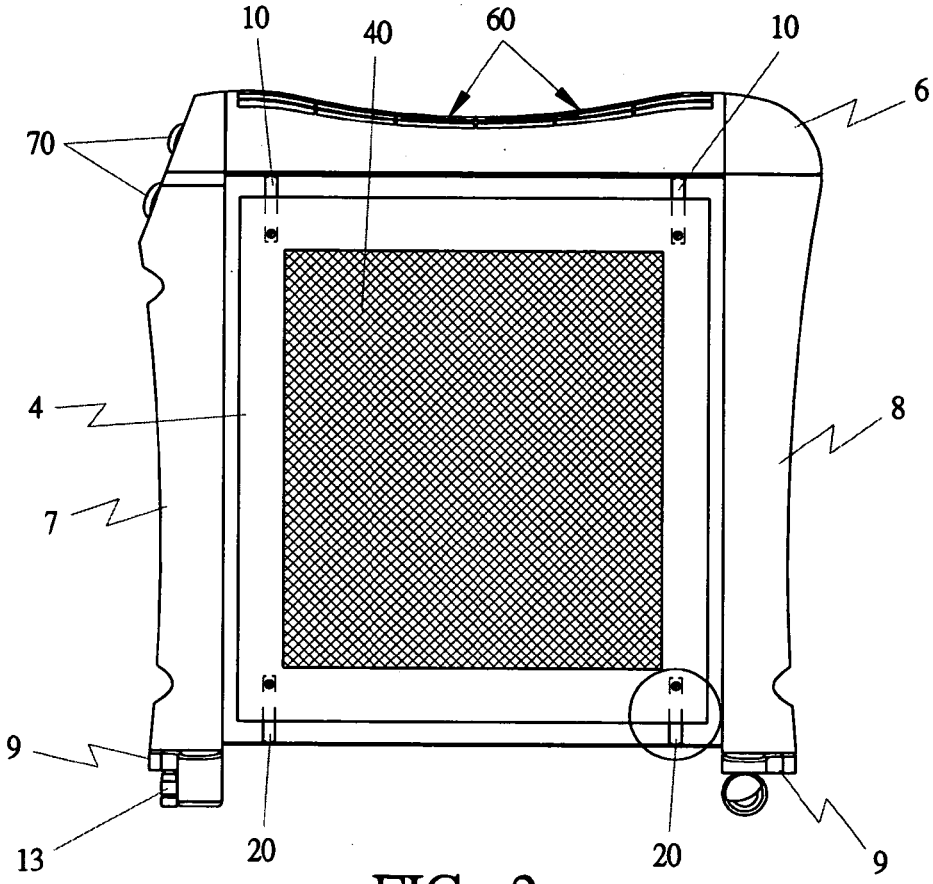
FIG. 2 is a side view of the convectional radial electric warmer in the present invention.
Figure 3:
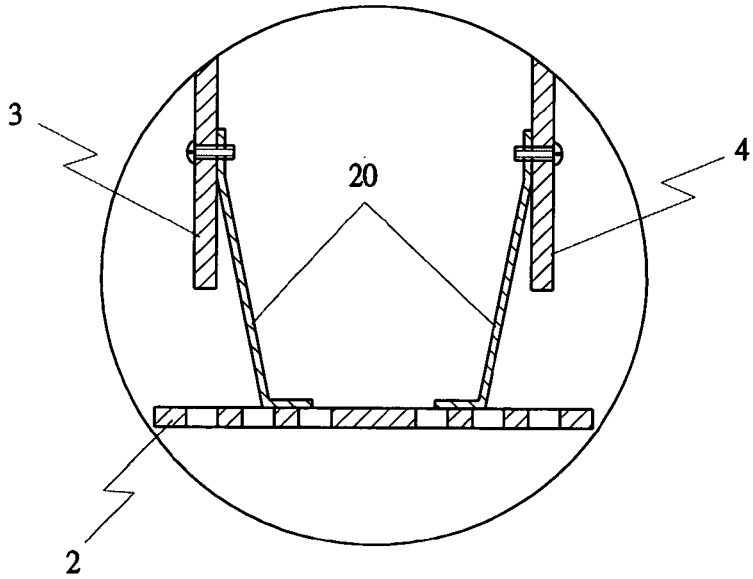
FIG. 3 is a partial magnified cross-sectional view of the part marked in the circle in FIG. 2; and, FIG. 4 is a perspective view of the convectional radial electric warmer in the present invention.
Figure 4:
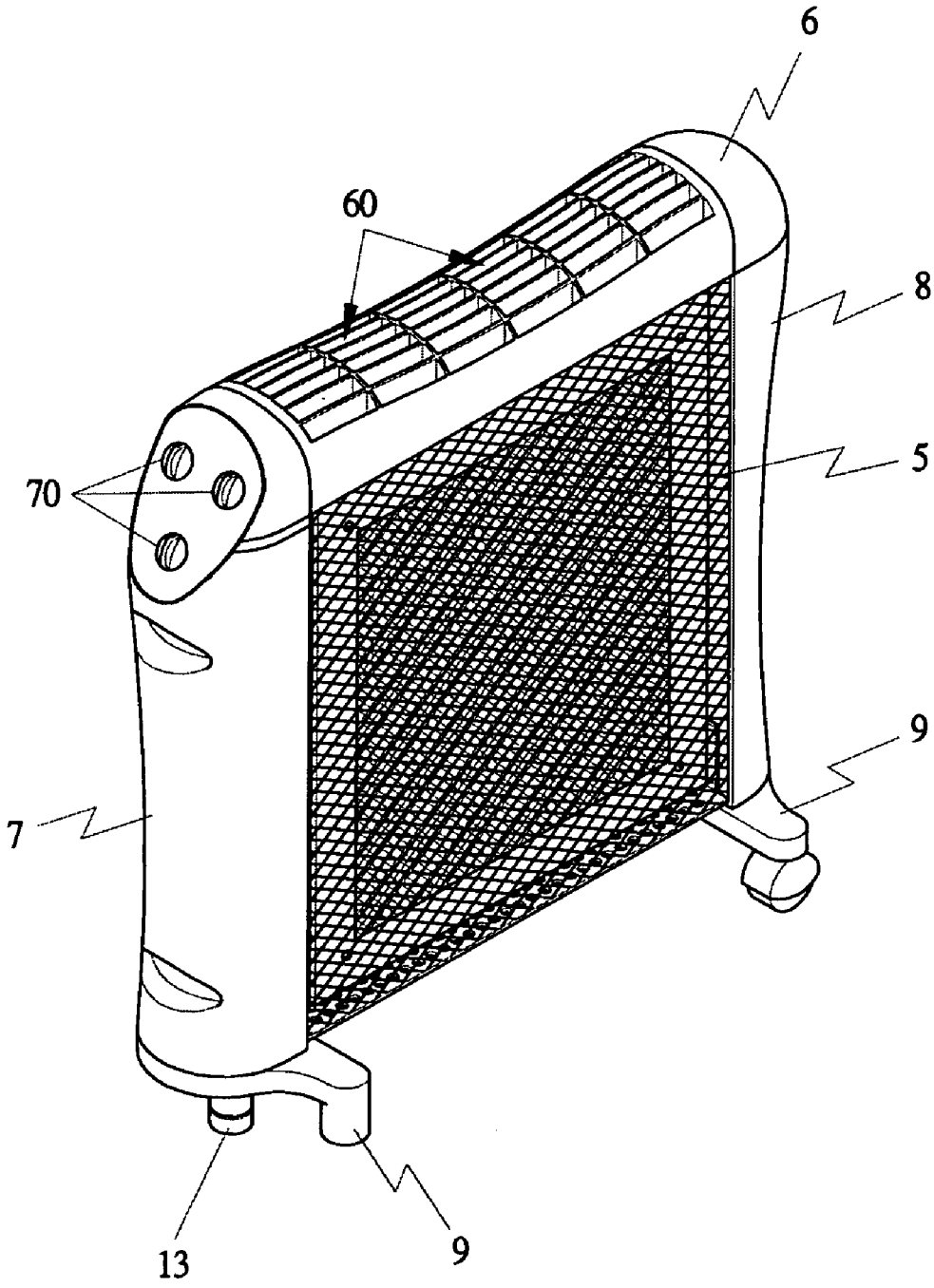

A preferred embodiment of a convectional radial electric warmer in the present invention, as shown in FIGS. 1, 2 and 3, includes an upper and a lower support base 1 and 2, two heaters 3, 4, a protective net 5, an upper, a front and a rear cover 6, 7 and 8 as main components combined together.

The upper and the lower support base 1 and 2 respectively have plural fixing members 10, 20 for securing stably the heaters, and plural holes for producing radial convection for hot air, and an upright wall 11, 21 and a flat wall 11, 21 respectively at the two ends for fixing the front and the rear cover 6 and 7.

The heaters 3 and 4 consist respectively of plural heating pieces and fixed at the outer side of the upper and the lower support base 1 and 2 with the fixing members 10 and 20 by bolts. Each heater 3, 4 has a heating film 30 and 40, which is made of concocted electric resistance plasma and printed on the heating pieces by means of net printing process and then burned by means of a burning process with high temperature, having high heat coefficient and easily controllable in its temperature.

The protective net 5 consists of plural pieces, secured stably at the outside of the heaters 3 and 4 by means of the upper and the lower support base 1 and 2, protecting the heaters 3 and 4 to obtain safety in use.

The upper, the front and the rear cover 6, 7 and 8 are secured stably respectively at the upper side, the front side and the rear side of the upper and the lower support base 1 and 2 with the upright walls 11 and 21 and the flat walls 11 and 21. Further, the upper cover 6 has plural exhaust holes 60 for hot air to flow through up, and the front cover 7 has plural control switches 70 for controlling various functions of the warmer. In addition, a front and a rear foot frame 9 and 9 are fixed under the lower support base 2 for keeping the warmer standing on the ground. The front cover 7 further has a protective switch 13 to automatically cut off the power in case of the warmer inclining and falling down so as to ensure safety of the warmer.

While the preferred embodiment of the invention has been described above, it will be recognized and understood that various modifications may be made therein and the appended claims are intended to cover all such modifications that may fall within the spirit and scope of the invention.

What is claimed is:

1. A convectional radial electric warmer comprising:

an upper and a lower support base respectively having plural fixing members, plural holes, and an upright wall at one end and a flat wall at the other end, said lower support base further fixed with a front foot frame and a rear foot frame extending under said lower support base to let said warmer stand on the ground;

plural heaters respectively consisting of plural heating pieces, secured at an outer side of said upper and said lower support base by said fixing members of said upper and said lower support base;

a protective net consisting of plural pieces, secured stably at the outer side of said heaters by said upper and said lower support base;

an upper, a front and a rear cover respectively fixed on the upper side, the front side and the rear side of said upper and said lower support base with said upright walls and said flat walls of said upper and said lower support base, said upper cover having plural exhaust holes, said front cover having a control switch.

2. The convectional radial electric warmer as claimed in claim 1, wherein said heaters are provided with an electric heating film, which comprises electric resistance material printed on a heat-enduring insulating base by means of a net printing process and then burned by a high temperature burning process.

3. The convectional radial electric warmer as claimed in claim 1, wherein a protective switch is fixed under said front cover for automatically cutting off the power of said warmer in case of said warmer inclining and falling down.

* * * * *